US006213019B1

(12) United States Patent
Muller

(10) Patent No.: US 6,213,019 B1
(45) Date of Patent: Apr. 10, 2001

(54) METHOD AND APPARATUS FOR INK FEED CONTROL

(75) Inventor: Joachim Muller, Pullach (DE)

(73) Assignee: MAN Roland Druckmaschinen AG (DE)

( * ) Notice: Subject to any disclaimer, the term of this patent is extended or adjusted under 35 U.S.C. 154(b) by 0 days.

(21) Appl. No.: 09/412,999

(22) Filed: Oct. 5, 1999

(30) Foreign Application Priority Data

Oct. 6, 1998 (DE) ..... 198 45 915

(51) Int. Cl.[7] ..... B41F 1/34

(52) U.S. Cl. ..... 101/484; 101/348; 101/450.1; 101/485

(58) Field of Search ..... 101/484, 492, 101/348, 485, 450.1, 148, 365, 349.1, 350.3

(56) References Cited

U.S. PATENT DOCUMENTS 4,656,941 * 4/1987 Broyman ..... 101/365
4,660,470 * 4/1987 Kramp et al. ..... 101/365
5,010,820 * 4/1991 Lüffler ..... 101/484
5,031,535 * 7/1991 Kipphan et al. ..... 101/350
5,148,747 * 9/1992 Rodi et al. ..... 101/450.1
5,383,395 * 1/1995 Buschulte ..... 101/485
5,447,102 * 9/1995 Pfeiffer et al. ..... 101/492
5,460,088 * 10/1995 Heiler et al. ..... 101/148
5,649,484 * 7/1997 Broghammer et al. ..... 101/248

FOREIGN PATENT DOCUMENTS 44 29 481 C2 12/1995 (DE) .

* cited by examiner

*Primary Examiner*—Eugene Eickholt
(74) *Attorney, Agent, or Firm*—Leydig, Voit & Mayer, LTD

(57) ABSTRACT

A method and apparatus for controlling the ink feed in a vibrator-type inking unit of a printing machine, especially a sheet-fed offset printing machine, the ink being fed via individual ink metering elements which interact with an ink fountain roller, and the ink metering elements and the vibrator cycle and/or the vibrator strip width being set to correspond to the overall proportion of the printing area of the printing plate and, in order to obtain pre-setting values for the ink feed, the proportion of the printing area in the individual ink metering zones being determined. The method and apparatus are intended to provide an improvement in the transient response of the inking for any desired subject. In the individual ink metering zones, the proportion of the printing area is compared with a predefined limiting value, and in the regions in which the proportion of the printing area is smaller than the predefined limiting value, ink is fed only in at least each second ink metering zone, and in those regions in which the proportion of the printing area is greater than the predefined limiting value, ink is fed in accordance with the proportion of the printing area in each metering zone.

9 Claims, 3 Drawing Sheets

METHOD AND APPARATUS FOR INK FEED CONTROL

TECHNICAL FIELD

This invention relates generally to a method and apparatus for ink-feed control in a vibrator-type inking unit of a printing machine and, more particularly, relates to a method and apparatus for calculating and providing optimal ink-metering settings.

BACKGROUND OF THE INVENTION

In sheet-feed offset printing machines, the ink to be printed is fed to a printing plate from an ink fountain roller via a vibrator roller, via ink rollers arranged downstream of the vibrator roller and ink applicator rollers. A number of ink metering elements which can be set individually and which correspond to ink-metering zones interact with the ink fountain roller. Such metering elements may be remotely controllable via associated drives. In this manner, the ink requirement in the individual ink metering zones corresponding to regions of the printing plate can be set in order to achieve the desired inking. Furthermore, the vibrator cycle and the vibrator strip width of the vibrator roller may be selected to further influence the ink feed. Inking units of sheet-fed offset printing machines usually also exhibit transverse ink flow. In other words, a quantity of ink fed in one ink-metering zone will generally influence to some extent the inking in adjacent metering zones. This transverse ink flow is further reinforced, depending on the subject to be printed, by the lateral distribution, which can also be set.

In the simplest case, the ink feed is set by hand according to an estimate by the printer, using the ink metering elements and vibrator roller. Thus, the ink metering elements and the settings on the vibrator roller, i.e cycle, and strip width, are set appropriately following a visual inspection of the subject printing plate. Automation of these presetting measures may be obtained using printing-plate readers or by using printing plate data derived from the pre-press stage. In a printing-plate reader, the proportion of the printing area in the individual ink metering zones is ascertained by recording the reflectance of the plate. Then, the settings of the ink metering elements are derived from the proportions of the printing area in the metering zones in accordance with predefined characteristic curves. Settings for the vibrator cycle and the vibrator strip width can be derived from the average ink requirement over all the ink metering zones, also known as the format width.

In the case of ascertaining ink pre-setting data from the pre-press stage, either the image data are used directly, or coarse-screen data are used to derive the proportion of the printing area. Here, too, the determination of the proportion of the printing area is carried out with respect to ink metering zones. Similarly, the determination of the vibrator cycle and vibrator strip width is carried out by taking into account the proportion of the printing area over all of the ink metering zones of the subject.

Because of the large number of rollers, the inking process of sheet-fed offset printing machines exhibits a pronounced inertia. That is, a change to the ink feed requires a certain amount of time and a certain number of imperfectly printed sheets before the desired inking change appears on the printed material. When adjustments are being made for a new print job, frequent adjustments in the ink feed are required until the intended inking is achieved. Since each change to the inking causes rejects, it is desirable that the number of inking changes, and thus the number of reject sheets, is kept as low as possible. The number of adjustments can be minimized by means of good ink pre-setting using pre-setting data. However, subsequent necessary inking changes will still produce reject sheets until a stable inking state is achieved. The time duration of this transient is increased if the proportion of the printing area is low; that is to say an inking change is established particularly slowly in the metering zones having a low proportion of the overall printing area.

DE 44 29 481 C2 discloses a method for feeding printing ink into a roller inking unit of a printing machine, in which, at least in one of the metering zones having a proportion of the printing area which is different from zero, the corresponding metering element is at least partly closed. An aspect of this method provides that, in the case of a low proportion of the printing area overall on the printing plate, only each second ink metering zone is opened, and the ink metering elements located in between always remain closed. This results in a higher ink flow in the opened ink metering zones, with the corresponding excess of ink being conveyed into the ink metering zones corresponding to closed ink meters.

However, this previously disclosed method can be used only when producing printed products in which the printing plate overall, that is to say over the entire format width, has a low proportion of printed area as compared to non-printed area. However, in many print jobs, subject regions containing a high proportion of printing area lie alongside subject regions having a low proportion of printing area. Accordingly, there exists a need for a method of metering inking in such circumstances to improve the transient response, and to minimize the number of reject sheets produced after inking setting changes.

SUMMARY OF THE INVENTION

The present invention provides a method and apparatus for controlling the ink feed in a vibrator-type inking unit of a printing machine. The method and apparatus of the invention largely avoid the aforementioned disadvantages while providing a noticeable improvement in the transient response of the inking.

This object is achieved by selectively pre-setting the ink feed. The proportion of the printing area in the individual ink metering zones is determined, and this proportion of the printing area is compared with a predefined limiting value (GW). In the regions in which the proportion of the printing area is less than the predefined limiting value, ink is fed only in each second ink-metering zone. In those regions in which the proportion of the printing area is greater than the predefined limiting value (GW), the ink is fed in accordance with the proportion of the printing area in each metering zone.

Additional features and advantages of the invention will be made apparent from the following detailed description of illustrative embodiments which proceeds with reference to the accompanying figures.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION OF THE INVENTION

Figure 1:
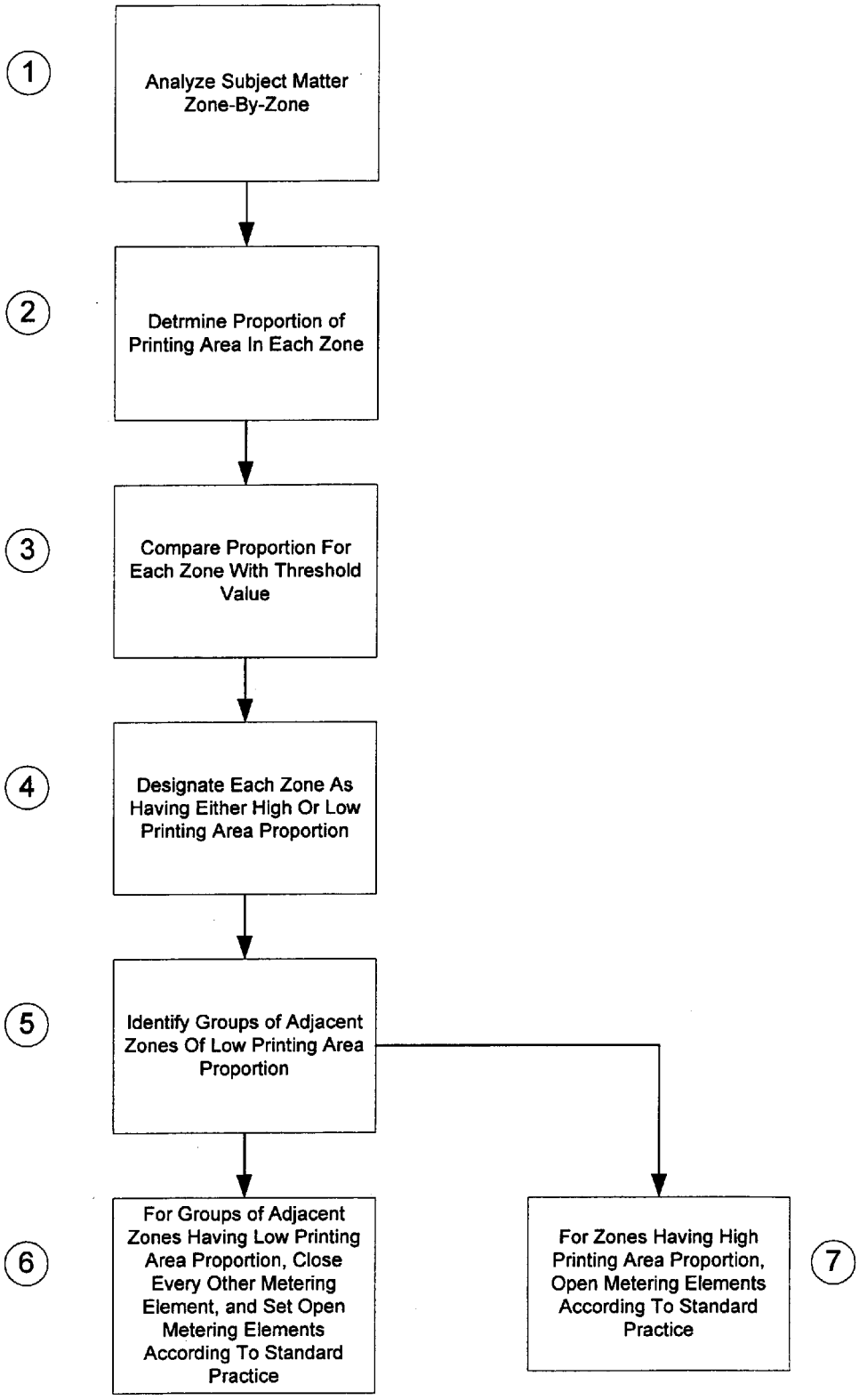
FIG. 1 is a flow chart illustrating the flow of operations in an embodiment of the invention.

The method and apparatus according to the invention allow advantageous setting of ink-metering elements for subject matter which contains areas of high printing proportion and areas of low printing proportion. A flow chart of the steps according to an embodiment of the invention is shown in FIG. 1. The subject matter to be printed is initially analyzed in each metering zone, as shown in Step 1. As shown in Step 2, it is then determined what proportion of the printing area, as opposed to non-printing area, is present in each zone. In Step 3, the proportion derived in Step 2 for each metering zone is compared to a predetermined threshold value. Subsequently, the metering zones across the width of the printing subject are designated in Step 4 as having either a high printing-area proportion or a low printing-area proportion. A high printing area proportion is a printing area proportion equal to or higher than the predetermined threshold value, while a low printing area proportion is a printing area proportion less than the predetermined threshold value.

Adjacent metering zones having printing proportions below this threshold value are grouped in Step 5. Subsequently in Step 6, every other metering element is closed within such groups. The open ink metering elements between the closed elements are opened in accordance with the ink requirement in a manner well known to those skilled in the art. The transverse ink flow in the form of the lateral distribution is preferably also taken into account in setting these latter metering elements.

In the ink metering zones in which the proportion of the printing area lies above the predefined threshold value, the ink metering elements are set in Step 7 in accordance with the ink requirement in the standard manner known to those skilled in the art, i.e. without alternating closed metering zones. In these regions as well, though, the transverse ink flow is preferably taken into account in the form of a parameter of the lateral distribution in setting each metering element. The aforementioned settings are preferably selected for a large vibrator strip width and, in particular, for the greatest possible vibrator strip width.

In an embodiment of the invention, setting values for the open ink metering elements both in the regions with a high proportion of printing area and in the regions with a low proportion of printing area take into account the anticipated transverse ink flow. This is preferably performed by first determining an effective metering element setting in accordance with a predefined characteristic curve from the proportion of the printing area in the respective zones. For example, the characteristic curve relating the proportion of the printing area to a corresponding setting value may simply be a straight line, of the form $y=mx+b$, although non-linear models may allow for increased accuracy. For example, mathematical models which take into account the details of the ink flow between the metering element and ink fountain roller, as well as the conditions in the inking unit, may also be used, but need not be. The effective setting values for the ink metering elements which are obtained in this way for each ink metering zone are then used to calculate the actual setting values for the open ink metering elements.

Figure 2:
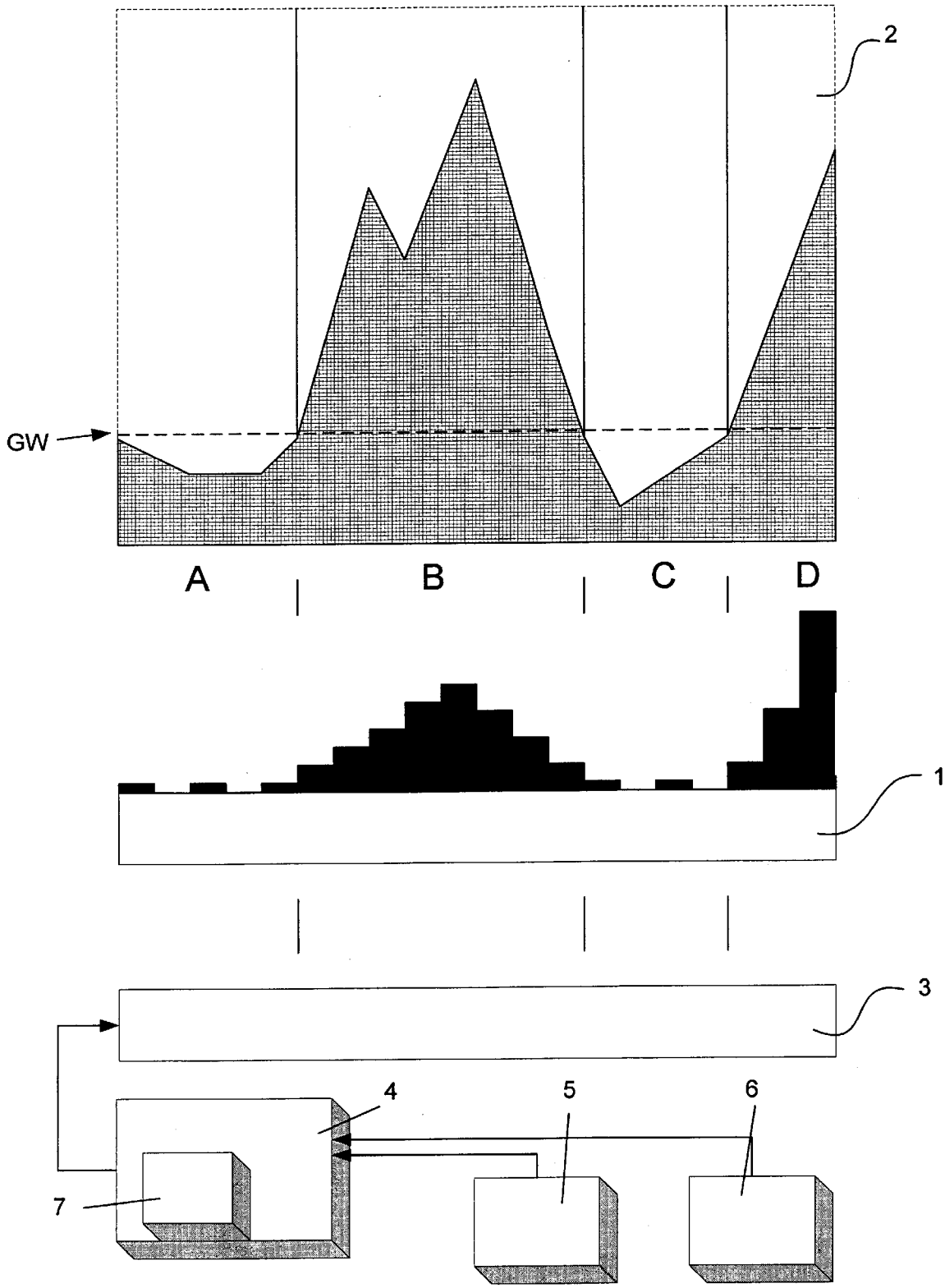
FIG. 2 is a schematic diagram showing pertinent portions of a printing machine and a printing plate in accordance with an embodiment of the invention.

FIG. 2 shows the basic components of an apparatus for implementing the method according to the invention. The inking unit of a printing machine comprises an ink fountain roller 1, with which ink-metering elements 3 interact in a manner well known to those skilled in the art. The ink metering elements 3 are driven by associated drives. The subject 2 of a printing plate is divided into regions and has proportions of printing area which vary depending upon the particular region of the plate.

The ink remote control console 4 which interacts with the ink metering elements 3 supplies pre-setting data from a printing-plate scanner 5 or from a pre-press stage data source 6 via an appropriate standard interface. The ink remote control console 4 preferably has associated with it a computer 7. The computer 7 may be of a typical von Neumann architecture, but need not be. Preferably, the computer 7 contains a processor unit 20 and is capable of executing computer-readable instructions.

Figure 3:
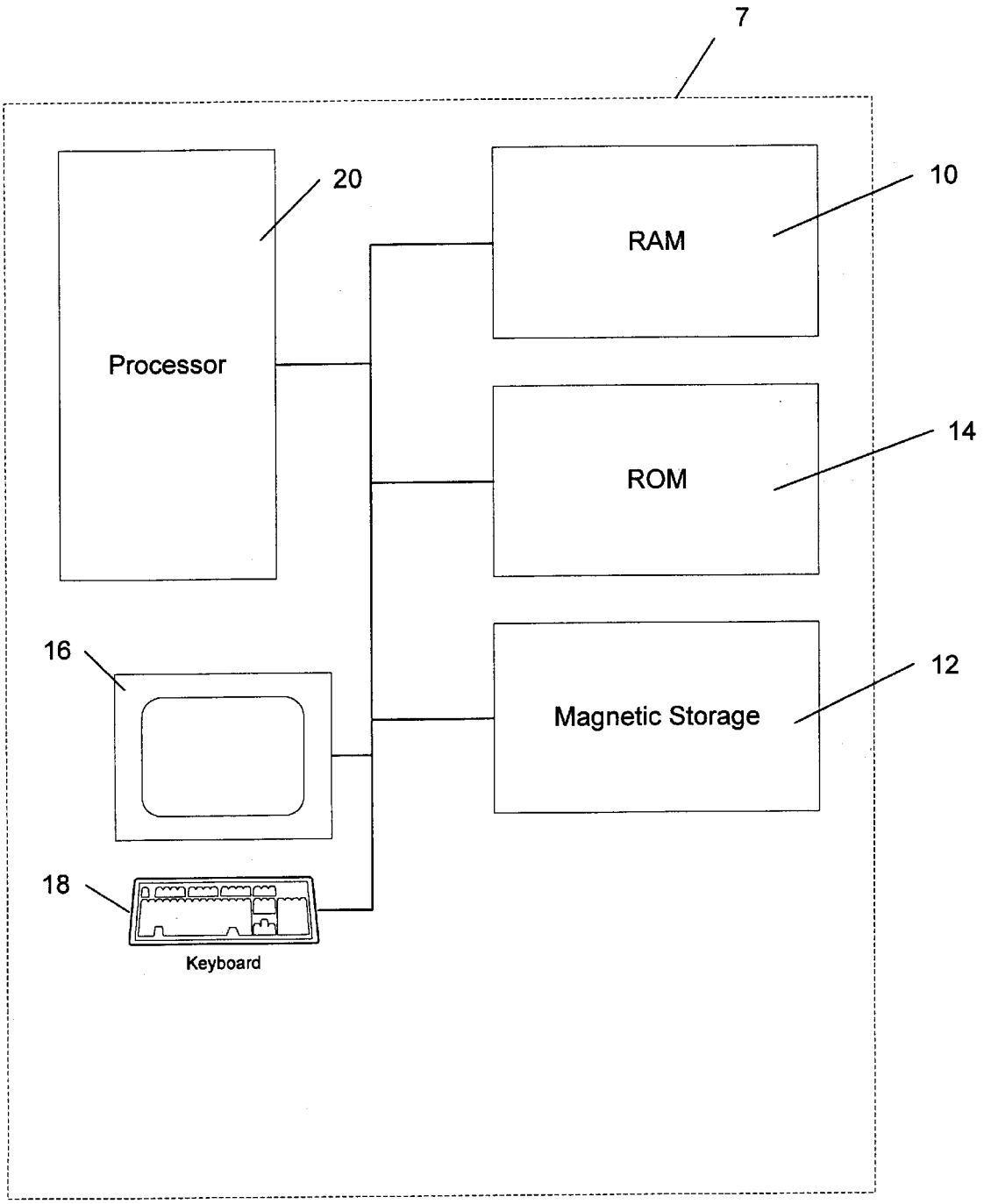
FIG. 3 is a block diagram generally illustrating an exemplary computer system usable in the present invention.

The computer 7 preferably has short term memory 10 such as random access memory (RAM) as shown in FIG. 3, usable by the computer 7 during execution of instructions to store data and/or instructions, as well as nonvolatile long term memory 12 such as a magnetic storage medium, for storing computer readable instructions, data structures, program modules, and other data. Typically, such long term storage consists of a hard-drive and floppy magnetic disk drive, but may be as simple as an electrically programmable read only memory (EPROM) or other non-volatile storage unit capable of providing access to instructions and information. As indicated, the long-term storage need not be read only, but may be. The computer 7 may also contain read only memory 14 (ROM) for storing basic routines for the computer. The computer 7 may also have an associated user interface such as a viewable monitor 16 and keyboard or keypad 18, usable by a human operator to exchange information with the computer.

In one case, the computer 7 may consist merely of a processor, with internal and/or external memory resources, and having appropriate input and output circuitry for data, timing, power, and so on, as is familiar to one of skill in the art. In the simplest case, it will be recognized by one of skill in the art that the "computer" 7 may consist simply of a non-programmable hard-wired circuit configured to carry out the necessary computations.

When employed in the present invention, the computer 7 is usable as a comparator to compare the proportion of printing area present in each ink metering zone with a predefined limiting value GW, and to subdivide and group the individual ink metering zones into groups of high or low printing proportion groups as exemplified by the regions A, B, C, D in FIG. 2. With respect to the exemplary plate of FIG. 2, regions A and C have a proportion of printing area which is low overall. In the regions B and D, the subject 2 has a large proportion of printing area. Following the comparison between the individual area coverage values in the metering zones with the predefined limiting value GW, the setting of the ink metering elements 3 is then carried out by the ink remote control system 4. As discussed, the calculation of settings preferably takes into account the transverse ink flow and the proportion of the printing area present in the respective ink-metering zone. The physical setting is carried out by using a characteristic curve that reproduces the relationship between ink layer thickness and ink-metering element setting. Such a curve may be arrived at empirically or otherwise.

Preferably, in the regions A and C, i.e. the regions with a low printing proportion overall, only every other ink-metering zone is opened as earlier described. The ink metering elements corresponding to metering zones located in between remain closed. In the regions B and D having a high printing proportion overall, the setting of the ink metering elements 3 is carried out in the standard manner well known to those skilled in the art, preferably taking into account the transverse ink flow.

In a further embodiment of the invention, the alternatingly closed ink metering elements described above may be set to a value which is close to but greater than zero, so that the ink metering elements are not brought completely into contact with the ink fountain roller. Thus a very thin ink film may be produced on the ink fountain roller which both reduces the mechanical wear on the ink metering elements and ink fountain roller and, at the same time, may improve the ink flow in these zones during transients.

All of the references cited herein are hereby incorporated in their entireties by reference. In view of the many possible embodiments to which the principles of this invention may be applied, it should be recognized that the embodiment described herein with respect to the drawing figures is meant to be illustrative only and should not be taken as limiting the scope of invention. For example, while it is described that every other ink-metering element be closed in groups of zones having printing proportions below the predefined threshold, one of skill in the art will appreciate that one might instead close every third element, etc. Additionally, it is not critical which particular elements are closed or open in such a group. For example, in such a group having an odd number of elements, in closing every other element, the first element in the group may be open or closed, yielding a greater or lesser number of open elements relative to closed elements. Those of skill in the art will recognize that the illustrated embodiment can be further modified in arrangement and detail without departing from the spirit of the invention. Therefore, the invention as described herein contemplates all such embodiments as may come within the scope of the following claims and equivalents thereof.

What is claimed is:

1. A method for controlling the ink feed in a vibrator-type inking unit of a printing machine wherein the ink feed is controllable by individual ink-metering elements which are associated with ink-metering zones, and which interact with an ink fountain roller, and wherein the ink metering elements and a vibrating cycle and a vibrator strip width are further usable to adjust the ink feed, comprising the steps of:

determining the proportion of printing area, in individual ink metering zones, of a subject to be printed;

comparing the proportion of the printing area in the individual ink metering zones with a predefined limiting value;

identifying a group of at least two adjacent zones each of which has a proportion of printing area smaller than the predefined limiting value;

in the group of at least two adjacent zones having a proportion of printing area to be printed smaller than the predefined limiting value, setting the ink metering elements such that ink is substantially fed only in a subset of the ink metering zones;

identifying zones which have a proportion of printing area greater than the predefined limiting value; and in each zone having a proportion of printing area greater than the predefined limiting value, setting the ink metering elements such that ink is fed in accordance with the proportion of the printing area in such metering zone.

2. The method according to claim 1, wherein the printing machine is a sheet-fed offset printing machine.

3. The method according to claim 1, wherein the steps of setting the ink metering elements further include the steps of determining the relationship between a metering element setting and ink layer thickness; and setting the ink-metering elements at least partially in accordance with said relationship.

4. The method according to claim 1, wherein the settings for the ink metering elements are determined at least partly as a function of transverse ink flow.

5. The method according to claim 2, wherein the settings for the ink metering elements are determined at least partly as a function of transverse ink flow.

6. The method according to claim 1, wherein the settings for the ink metering elements are determined for the greatest possible vibrator strip width.

7. An apparatus for remotely controlling the ink feed in a vibrator-type inking unit of a printing machine wherein the ink feed is controllable by individual ink metering elements which interact with an ink fountain roller, and wherein the ink metering elements and a vibrating cycle and a vibrator strip width are usable to adjust the ink feed, comprising a comparator for comparing the proportion of printing area of a printing plate in an ink metering zone with a predefined limiting value;

a setting element communicably connected to the ink metering elements, wherein the setting element is adapted to substantially open only a subset of the ink metering elements to feed ink in the regions in which the proportion of the printing area to be printed is lower than the predefined limiting value, and to open each ink metering element to feed ink in accordance with the proportion of the printing area in the regions in which the proportion of the printing area is greater than the predefined limiting value.

8. The apparatus according to claim 7, wherein the setting element is adapted to set any open ink metering elements at least partly in accordance with a transverse ink flow.

9. The apparatus according to claim 7, wherein the setting element is adapted to set any open ink metering elements for the greatest possible vibrator strip width.

* * * * *